US010529165B2

(12) United States Patent
Marquis et al.

(10) Patent No.: US 10,529,165 B2
(45) Date of Patent: Jan. 7, 2020

(54) CUP LID STORAGE AND DISPENSING APPARATUS

(71) Applicants: Todd A. Marquis, Canton, GA (US); Brooke Breunig, Cumming, GA (US)

(72) Inventors: Todd A. Marquis, Canton, GA (US); Brooke Breunig, Cumming, GA (US)

( * ) Notice: Subject to any disclaimer, the term of this patent is extended or adjusted under 35 U.S.C. 154(b) by 25 days.

(21) Appl. No.: 15/394,139

(22) Filed: Dec. 29, 2016

(65) Prior Publication Data

US 2017/0193733 A1 Jul. 6, 2017

Related U.S. Application Data

(60) Provisional application No. 62/273,538, filed on Dec. 31, 2015.

(51) Int. Cl.
*G07F 9/02* (2006.01)
*G07F 11/24* (2006.01)

(52) U.S. Cl.
CPC ..... *G07F 9/026* (2013.01); *G07F 11/24* (2013.01)

(58) Field of Classification Search
CPC ..... A47F 1/085; A47F 1/106; G07F 9/026; G07F 11/005; G07F 11/24
See application file for complete search history.

(56) References Cited

U.S. PATENT DOCUMENTS 1,344,692 A * 6/1920 Hill ..... G07F 13/10 193/2 E
4,319,441 A 3/1982 Credle
4,341,325 A * 7/1982 Lowdermilk ..... B65B 3/027 221/211
4,643,334 A 2/1987 Steele
5,064,093 A * 11/1991 Davis ..... B65G 59/108 221/222
5,131,562 A * 7/1992 Brown ..... A47F 1/106 221/193
5,328,052 A 7/1994 Kizilos
5,944,220 A 8/1999 Garske
6,786,359 B1 * 9/2004 Schroeder ..... B65B 43/44 221/222
7,337,919 B2 * 3/2008 Walsh ..... A47F 1/106 221/116
8,186,544 B2 * 5/2012 Mills ..... B65D 83/0083 141/360
2005/0092767 A1 * 5/2005 Schroeder ..... A47F 1/085 221/208

(Continued)

*Primary Examiner* — Gene O Crawford
*Assistant Examiner* — Kelvin L Randall, Jr.
(74) *Attorney, Agent, or Firm* — Kim and Lahey Law Firm LLC; Seann P. Lahey; Douglas W. Kim

(57) ABSTRACT

This invention is an automatic lid dispenser that can include a hopper assembly for receiving and storing an inventory of lids; a dispensing assembly disposed adjacent to the hopper assembly for receiving lids from the hopper assembly; a plurality of pinions included in the dispensing assembly wherein the pinions include pinion threads spaced apart to contact a lid edge; a drive assembly included in the dispensing assembly having a drive motor cooperatively associated with the pinions to rotate the pinions to dispense a lid; and, a ramp disposed under the dispensing assembly for receiving the lid and redirecting the lid external the housing containing the dispensing assembly.

13 Claims, 11 Drawing Sheets

(56) References Cited

U.S. PATENT DOCUMENTS

| | | | | |
|---|---|---|---|---|
| 2007/0228066 | A1* | 10/2007 | Almas | B65D 83/0858 221/211 |
| 2008/0011772 | A1* | 1/2008 | Morris | A47K 10/36 221/258 |
| 2009/0121429 | A1* | 5/2009 | Walsh | A63F 1/14 273/149 R |
| 2011/0101017 | A1* | 5/2011 | Schroeder | B65G 59/108 221/1 |
| 2011/0210137 | A1* | 9/2011 | Kling | A47K 10/36 221/6 |
| 2016/0107820 | A1* | 4/2016 | MacVittie | A61J 7/0472 221/13 |
| 2016/0113414 | A1* | 4/2016 | Weber | G07F 11/16 221/6 |

* cited by examiner

CUP LID STORAGE AND DISPENSING APPARATUS

BACKGROUND OF THE INVENTION

1) Field of the Invention

The present invention relates to a storage and dispensing apparatus for dispensing cup lids for high volume users such as fast food restaurants and the like.

2) Description of Related Art

In the restaurant industry, including fast food, convenience store, and other locations that offer fountain drinks, coffee, and the like, it is common to have a stack of cups and lids for consumers to use. Cups are typically stacked inside each other so that the sterilization of the interiors of the cup can be maintained during shipping, storage, and dispensing as the interior of the cup is protected by the adjacent cup. However, lids are another story.

The lid is typically stored in a tray, tubular dispenser or other such article where the consumer comes in contact with the underside or top of the lid of the adjacent lid when retrieving the primary lid for use. This can result in undesirable material transfer from the consumer to the adjacent lid. For example, the influenza virus may be transferred by several methods including contact with contaminated objects. As reported by the Center for Disease Control, an infected person will frequently touch their nose or conjunctiva, placing virus on the hand which can then be transferred to objects such as the adjacent lid of a lid dispenser.

There have been some attempts to provide lid dispensers that improve on the open tray method such as with U.S. Pat. No. 5,944,220 that discloses a sanitized dispenser for use with plastic lids with the tubular housing opened at a downward terminal end where lids are retrievable through a finger opening in the side of the tubular housing. By its design, the consumer placed his or her finger in contact with the desired lid and can also contact the adjacent lid. Additionally, the lid that is to be dispensed is unprotected from its environment. U.S. Pat. Nos. 4,643,334 and 5,328,052 also includes these disadvantages.

There are also other devices that can automatically dispense lids, but none are well suited for use by the consumer for the now popular self-serve drink machines as are commonly found in restaurants. For example, U.S. Pat. No. 4,319,441 is a device that is a post drink dispensing system in combination with soft drink ingredients, ice, cup and lid and in a carousel arrangement to quickly move multiple cups through an arc.

Accordingly, it is an object of the present invention to provide a cup lid dispensing system that protects the lid from physical contact when an adjacent lid is retrieved by a user.

It is another object of the present invention to provide to a cup lid dispensing system that protects the lid from an open environment.

SUMMARY OF THE INVENTION

The above objectives are accomplished according to the present invention by providing: An automatic lid dispenser comprising: a hopper assembly carried by a support plate for receiving and storing an inventory of lids; a cartridge removably attached to the hopper assembly rotatable along a vertical axis between a loading position and an operating position; a dispensing assembly disposed adjacent to the hopper assembly for receiving lids from the cartridge; a plurality of pinions included in the dispensing assembly wherein at least one pinion includes pinion threads spaced apart to contact a lid edge wherein the plurality of pinions define an inner diameter that is smaller than a diameter of an unflexed lid; a transition area included in each pinion for guiding the lid edge into the pinion threads as the lid is received from the hopper assembly; a drive assembly included in the dispensing assembly having a drive motor cooperatively associated with the pinions to rotate the pinions to dispense a lid; a ramp disposed under the dispensing assembly for receiving the lid and redirecting the lid external the housing containing the dispensing assembly; a ramp sensor carried by the ramp for detecting the presence of a lid on the ramp; a buffer attached to the dispensing assembly to guide lids dispensed from the dispensing assembly onto the ramp; a ramp shield attached to the ramp covering the ramp sensor; a pair of guide arms attached to the ramp for positioning the lid at a distal end of the ramp; a control circuit connected to the drive motor and ramp sensor configured to activate the drive motor when the ramp sensor does not detect a lid on the ramp; a level sensor included in the hopper assembly to detect the level of lids in the lid inventory; the control circuit is connected to the level sensor and configured to prevent activation of the drive motor when the level of lids in the hopper assembly falls below a predetermined level; and, an indicator connected to the control circuit configured to be activated when the number of lids in the hopper assembly falls below a predetermined level.

The invention can include guide arms separated at a distance at their distal ends less than a diameter of the lid. A control circuit can be configured to stop activating the drive motor after a predetermined period of time after the drive motor is activated and a lid is not detected. There can be a pinion gear included in the pinion; a drive gear attached to the drive motor; and, a belt carried by the drive gear and pinion gear to transfer rotational force from the drive motor to the pinions thereby rotating the pinions. An outer gear can be cooperative associated with the drive gear and pinion gear to transfer rotational force from the drive motor to the pinions thereby rotating the pinions.

The invention can include a cartridge opening in a cartridge for loading lids into the cartridge. The cartridge opening can be disposed in the side of the cartridge. The ramp can be disposed under the dispensing assembly for receiving the lid and redirecting the lid external a housing containing the dispensing assembly.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein:

FIG. 2 is a perspective side view of aspects of the invention;

FIG. 3 is perspective side view of aspects of the invention;

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Figure 1A:
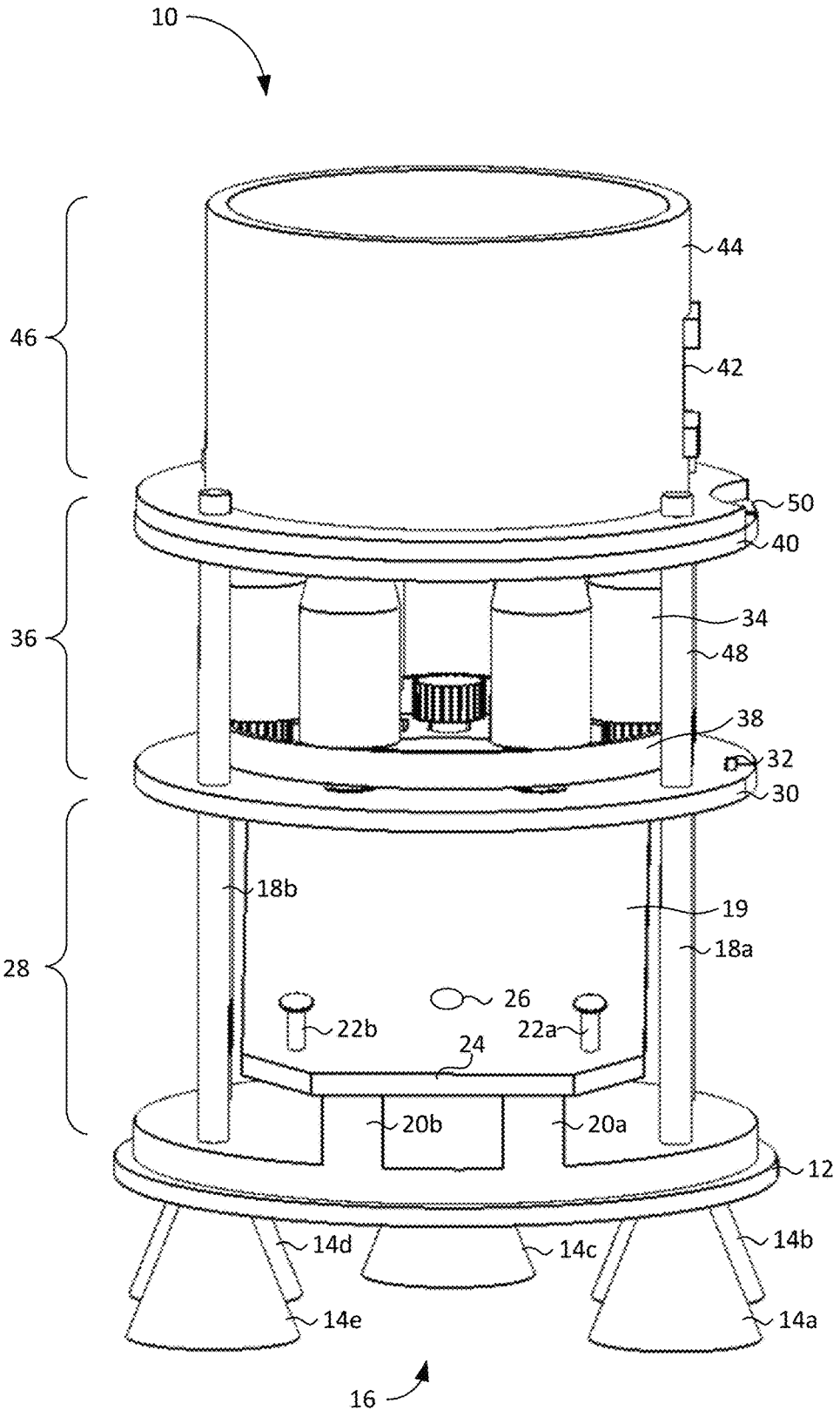
FIGS. 1A, 1B and 1C show a front view of aspects of the invention.
Figure 8:
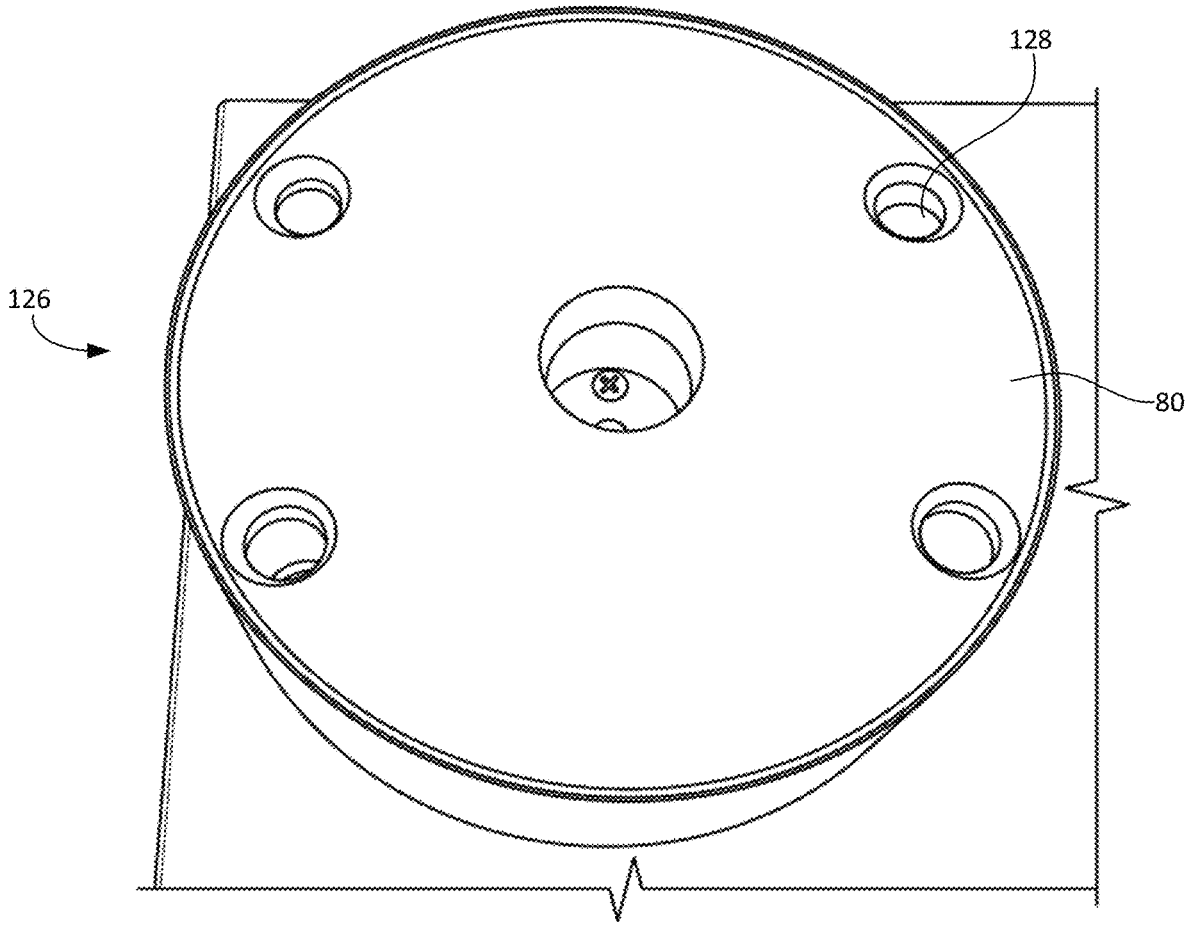
FIG. 8 is a perspective view of aspects of the invention.

Referring to FIG. 1A, the cup lid storage and dispenser assembly 10 is shown. A base plate 12 has supports 14*a* through 14*e* attached to the underside of the base plate, in one embodiment. A support space 16 is provided and defined between supports 14*a* and 14*e* that can allow the ramp to extend downwards and in one embodiment, into a base 80 (FIG. 8). The housing 11 (shown dotted in FIG. 1B) can include an opening where the ramp extend through and allow lids to be positioned on the ramp with at least a portion of the lid exterior to the housing.

Vertical supports 18*a* and 18*b* can be attached to the base plate and extend through the base plate in one embodiment. The ramp 19 can be attached to and supported by ramp supports 20*a* and 20*b* to support the ramp at least partially above the base plate. Stops 22*a* and 22*b* can be attached to the feed ramp to prevent lids that are dropped onto the ramp 19 from sliding off the distal end 24 of the ramp. A ramp sensor 26 can be carried by the ramp and detect if a lid is located on the ramp or if a consumer's hand passes over or near the sensor indicating that a lid is requested. The sensor can be in electronic communications with a control circuit 27 (FIG. 4) that can receive information from the sensor representing is a lid located on the ramp or if the consumer is requesting a lid. The ramp can be disposed in a ramp area 28.

An intermediate plate 30 can be supported by the vertical supports above the base plate. The intermediate plate can include a wiring opening 32 to receive various wiring sensors. A set of pinions 34 can be rotatably attached to the intermediate plate to contact lids and place lids on the feed ramp.

Referring to FIG. 1A, the pinions can be included in a dispensing assembly 36. The pinions can engage a drive belt 38 that, when rotated, causes the pinions to rotate. The pinions can be rotatably attached to the top plate 40. A level sensor 42 can be included in a cartridge 44 or in a hopper assembly 46 for detecting if there is a sufficient number of lids in the hopper and transmit the lid level information to the control circuit. The cartridge can be rotatably and/or removably attached to the hopper assembly 46. The vertical supports 48 can extend from the base plate through the intermediate plate into the top plate. The top plate can include a top connector 50 to attach the assembly to another structure such as another dispenser, the wall, and the like.

Figure 1B:
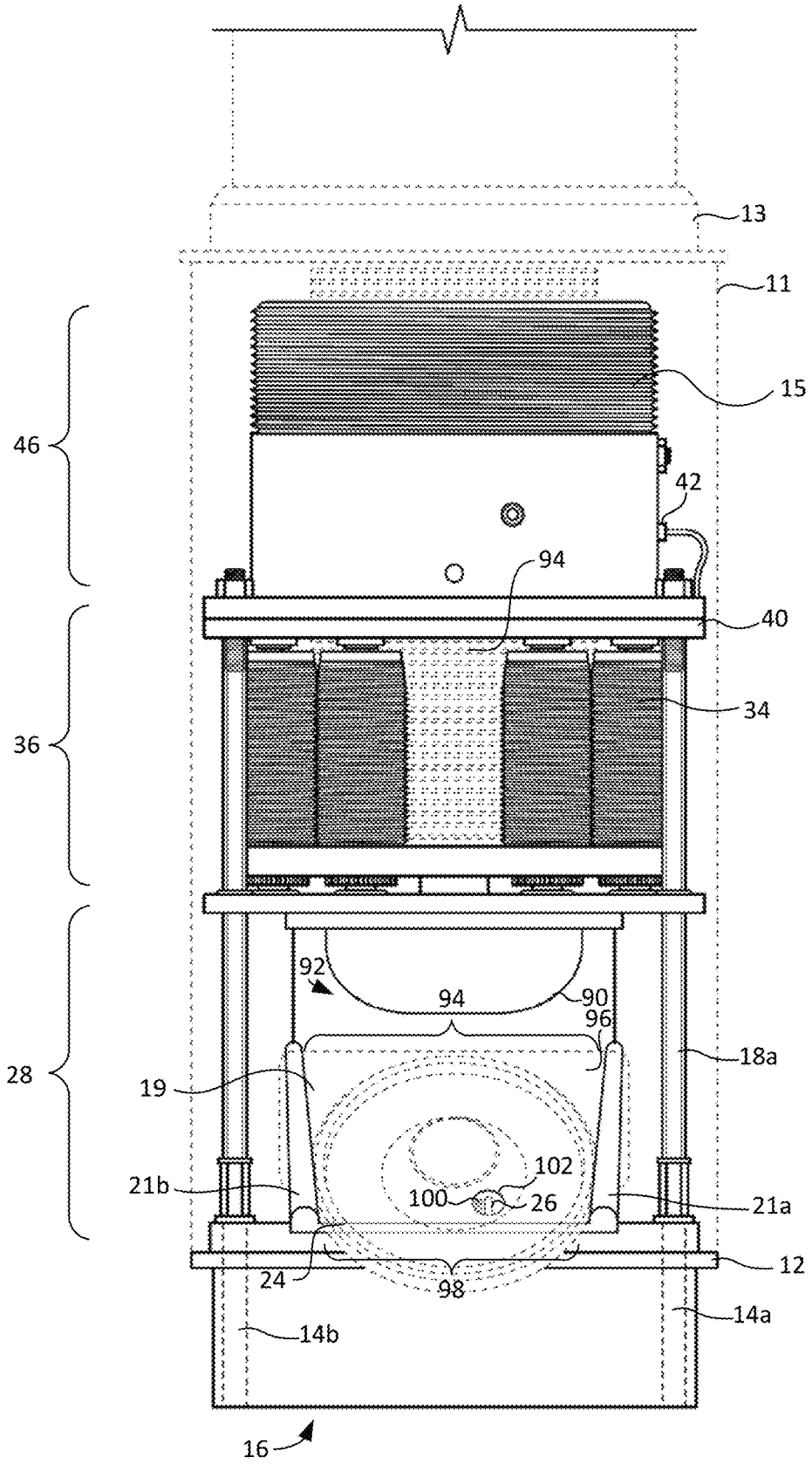

Referring to FIG. 1B, the invention is shown with is components contained inside a housing 11 shown with a dotted line. The housing can include a top ring 13 that can be removed from the housing. A buffer 90 can be attached to the dispensing assembly or otherwise disposed above the ramp to guide lids dispensed from the dispensing assembly onto the ramp. The buffer can include a radius edge 92. The buffer can include a curved wall. The dispensing assembly can receive and store an inventory of lids 94. The ramp 19 can include ramp arms 21*a* and 21*b* to assist guiding the lids to distal end 24 of the ramp. The ramp arms can have a proximal distance 94 between the ramp arms at a proximal end 96 of the ramp larger than the diameter of a lid. The ramp arms can have a proximal distance 98 at distal end 24 of the ramp smaller than the diameter of a lid. The distance between the ramp arms can gradually decrease from the proximal to the distal end of the ramp. The ramp arms can extend the length of the ramp or can be disposed at the distal end of the ramp.

An indicator 100 can be carried by the base plate and actuate when the lid level from the hopper assembly drops below a predetermined lever or when the dispensing assembly is actuated and no lid drops from the lid inventory after a predetermined period of time. The indicator can be visual, audible or both. The indicator can be carried by the assembly or remote to the invention so that information can be transmitted by wired to wireless communications to the indicator notifying an individual that remedial action is needed. In one embodiment, the indicator can be disposed in the sensor opening 102 in the ramp so if the indicator is disposed beneath the ramp upper surface, the indicate is viewable through the ramp. The ramp can include a transparent or semi-transparent ramp cover 104 (FIG. 4) to protect the indicator and the ramp sensor. In one embodiment, the ramp cover is polycarbonate such as that marketed under the brand Lexan®.

Figure 1C:
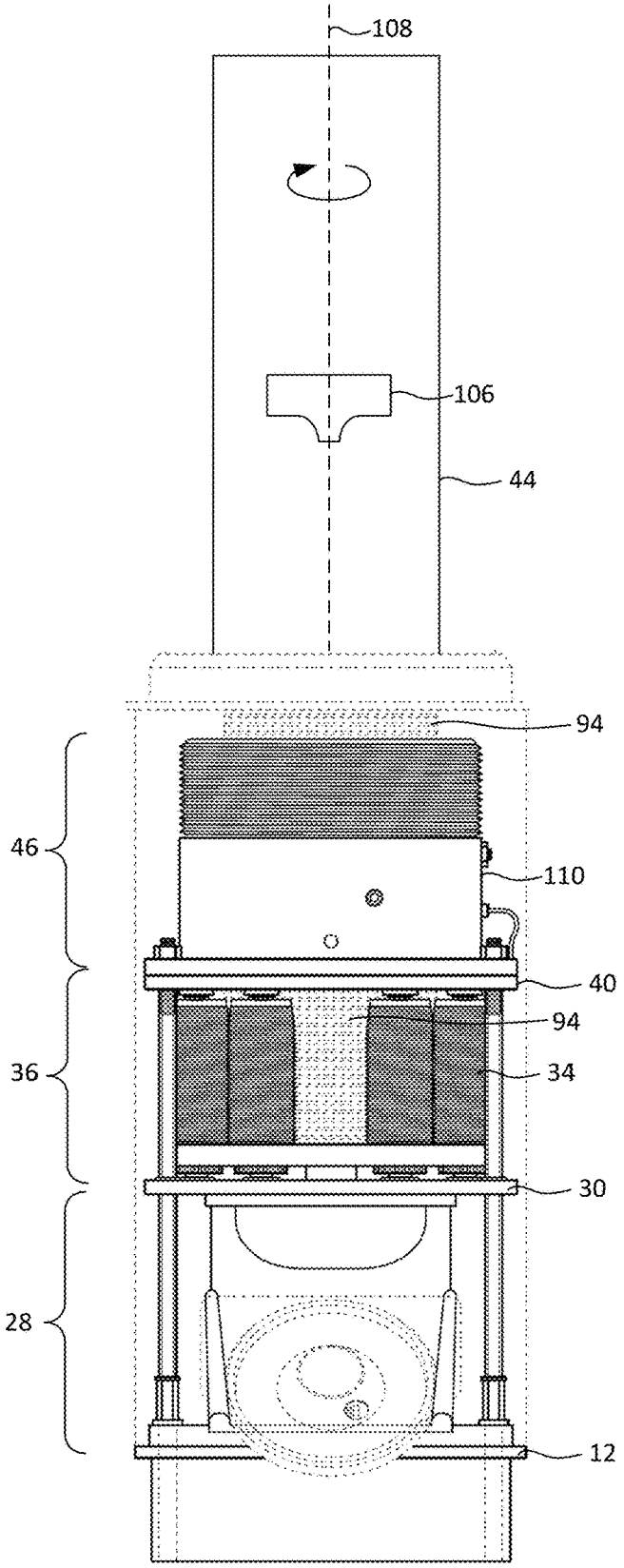

Referring to FIG. 1C, cartridge 44 is shown attached to the hopper assembly. The cartridge can be removable from the hopper assemble so that an empty cartridge can be replaced with a full cartridge. The cartridge can include a cartridge opening 106 allowing lids to be placed in the cartridge. The opening can be disposed the top of the cartridge or defined in the side of the cartridge. By placing the cartridge opening in the side, lids can be placed into the cartridge without having to reach to the top of the cartridge. The cartridge can rotate along a vertical cartridge axis 108 so that the cartridge opening can be rotated away from the ramp reducing or eliminating the ability of user to touch or otherwise contaminate lids in the cartridge.

The lid inventory 94 can have a predetermined minimum level such as maintaining lids above the pinions. The level sensor can determine when the inventor of lids drops below a hopper assembly cowl 110, the upper plate, the top of the pinions, above the pinion transition area 84 (FIG. 6) or other predetermined level. When the level of the lids drops below the predetermined level, the control circuit can prevent the drive from actuating and actuate the indicator thereby warning that the lid level is too low and the hopper assembly should be refilled.

Figure 2:
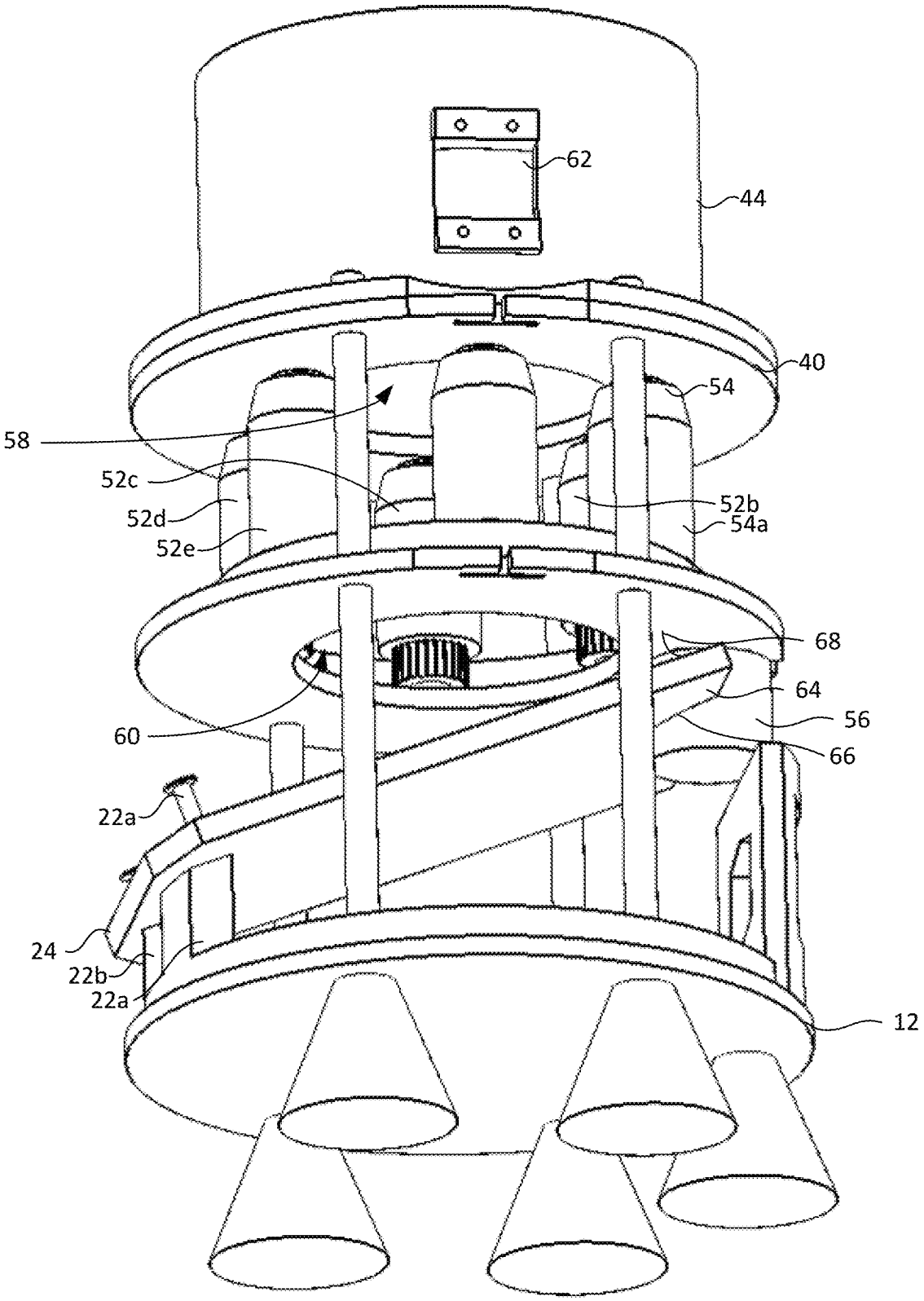
FIG. 2 shows a perspective view from the side of aspects of the invention.

Referring to FIG. 2, the set of pinions can include pinions 52*a* through 52*e*. Each pinion can include a tapered portion 54 in the transition area 84 (FIG. 6) that can assist with engaging a lid stored in the hopper assembly and to place the lid on the ramp. A drive 56 can be used to rotate the belt to rotate the set of pinions resulting in the lid being drawn from the lid inventory through upper opening 58, lower opening 60 onto the ramp. The hopper can also include an opening 62 allowing visual inspection of level of lids stored on the hopper.

The ramp can include a rear ramp extension 64 that has a concave ramp area 66 that can receive the drive. The ramp can have an angle 68 defined between the horizontal plane of the intermediate plate and the ramp in the range of 20 to 70 degrees. In one embodiment, the angle is about 45 degrees.

Figure 3:
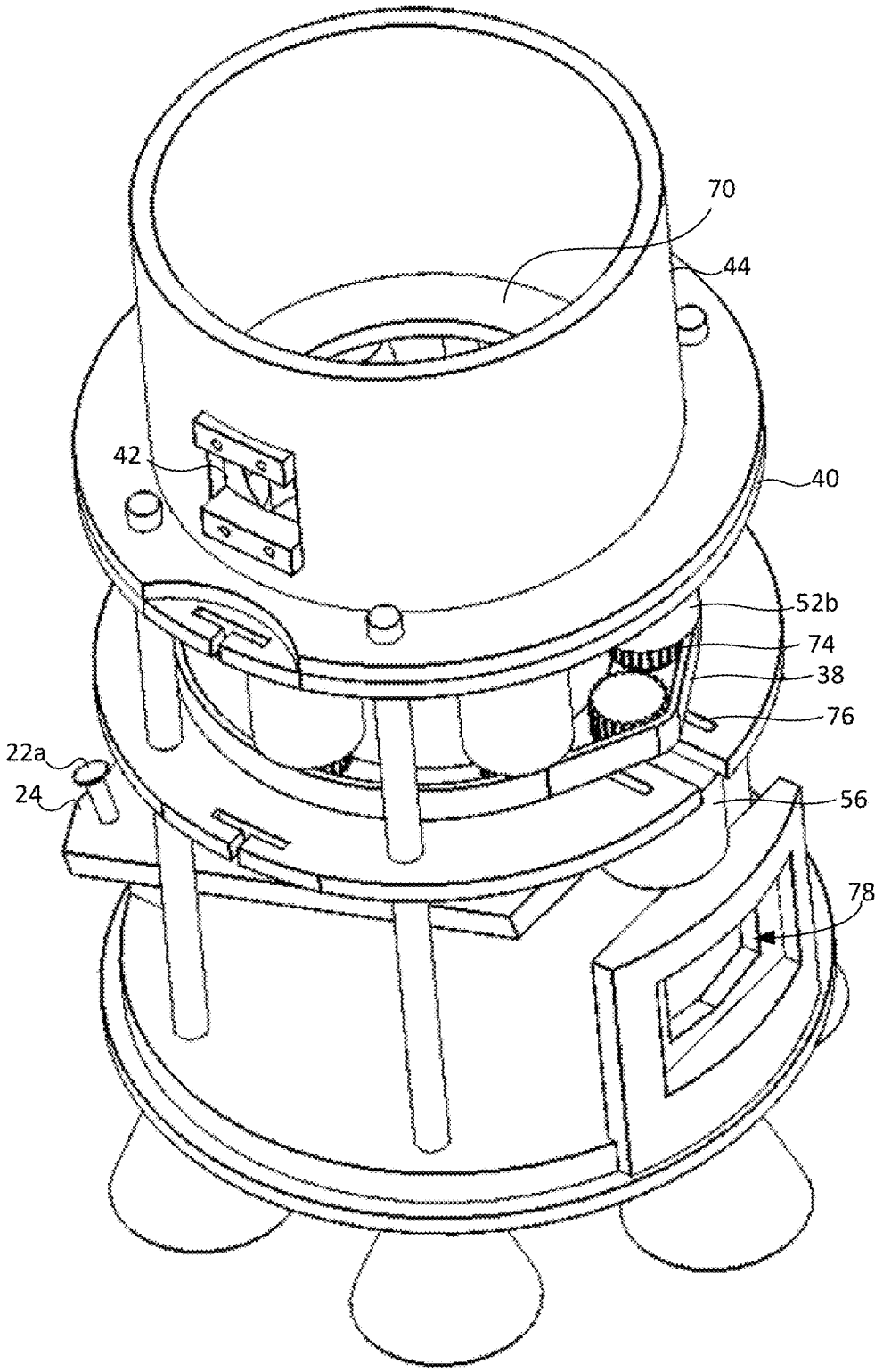
FIG. 3 shows a perspective view from the rear quarter of aspects of the invention.

Referring to FIG. 3, the hopper assembly can include in cartridge support 70 that can support the cartridge having lids. When originally manufactured, lids may come in plastic bags, cardboard boxes or circular containers all of which can be used as a cartridge of to fill a cartridge. In the embodiment when the cartridge is rigid, such as a cardboard box, the lower end of the cartridge can be opened and placed on the cowl. In one embodiment, the cowl can include a threaded portion 15 (FIG. 1B). The edges of the opened end of the cartridge can be positioned on the cartridge support and allow the cartridge to be supported vertically while allowing the lids to drop onto the pinions and ultimately the ramp.

The drive can include a drive gear 72 (FIG. 5) attached to the drive for engaging with the drive belt and rotating the drive belt. Each pinion can include a pinion gear 74 that engages the drive belt and causes the roller to rotate when the drive rotates the drive gear. The drive gear can be attached to the intermediate plate through drive slots 76 allowing the drive gear to move to and from the perimeter of the intermediate plate relative to the lower opening to accommodate differing tension on the drive belt. A power supply and controller can be included at attached at a mount 78 that can be attached to the base plate, intermediate plate, vertical support or any combination thereof.

Figure 4:
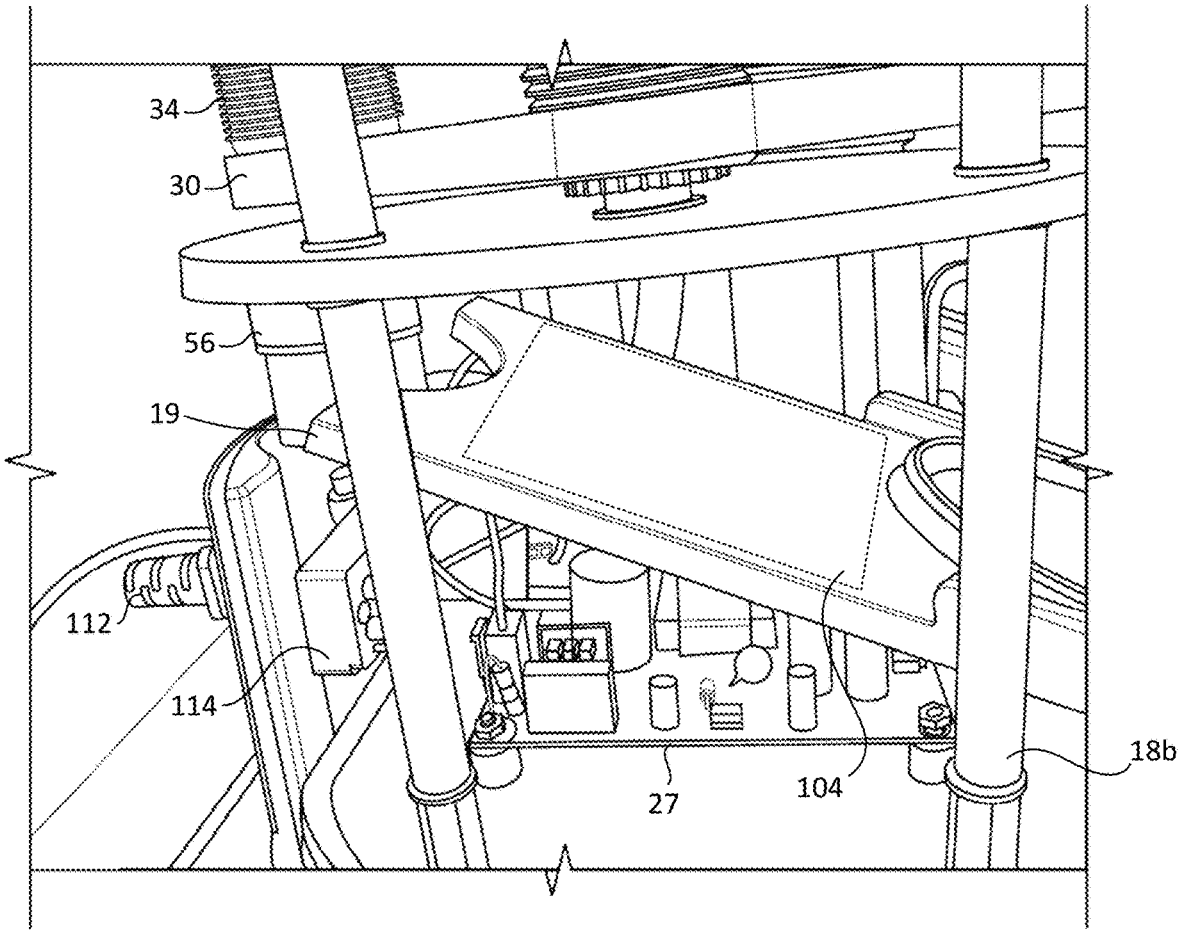
FIG. 4 is a side view of aspects of the invention.

Referring to FIG. 4, the control circuit can be supported by the base plate and disposed under the ramp. External power 112 can be provided to the control circuit as well as a power switch 114. The controller can include a programmable logic controller that can: receive information from the ramp sensor representing that there is no lid present on the fed ramp and actuate the drive to cause the rollers to rotate to cause a lid to drop to the feed ramp; receive information from the ramp sensor representing that the consumer requests a lid and actuate the drive to cause the rollers to rotate to cause a lid to drop to the feed ramp; receive information from the level sensor and actuate an indicator that the lid level is below a predetermined level; receive information from the lid level sensor and if the lid level is below a predetermined level, prevent the actuation of the drive; receive information from the drive so that if the drive is actuated for a predetermined period of time without the ramp sensor detecting a lid, an error condition can be established and the indicator actuated indicating the need for remedial action.

Figure 5:
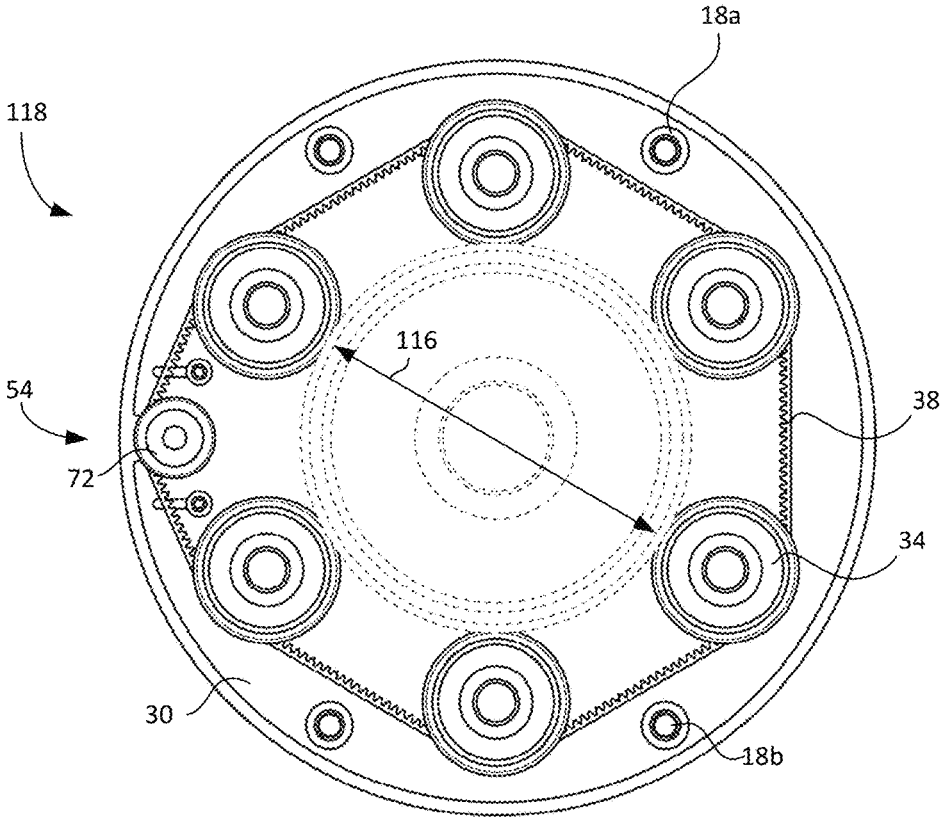
FIG. 5 is a top view of aspects of the invention.

Referring to FIG. 5, the pinion can define an inner diameter 116 that is smaller than the diameter of a lid. When the lids are in the lid inventory, there is a tendency of the lid to "stick" the adjoining lids. By forcing the lid edge through the pinions by the pinion threads, the lid is bowed relative the adjacent lid and more easily separates from the adjacent lid. The drive assembly 118 can include the pinions 34, belt 38, drive gear 72 that is driven by a drive motor.

Figure 6:
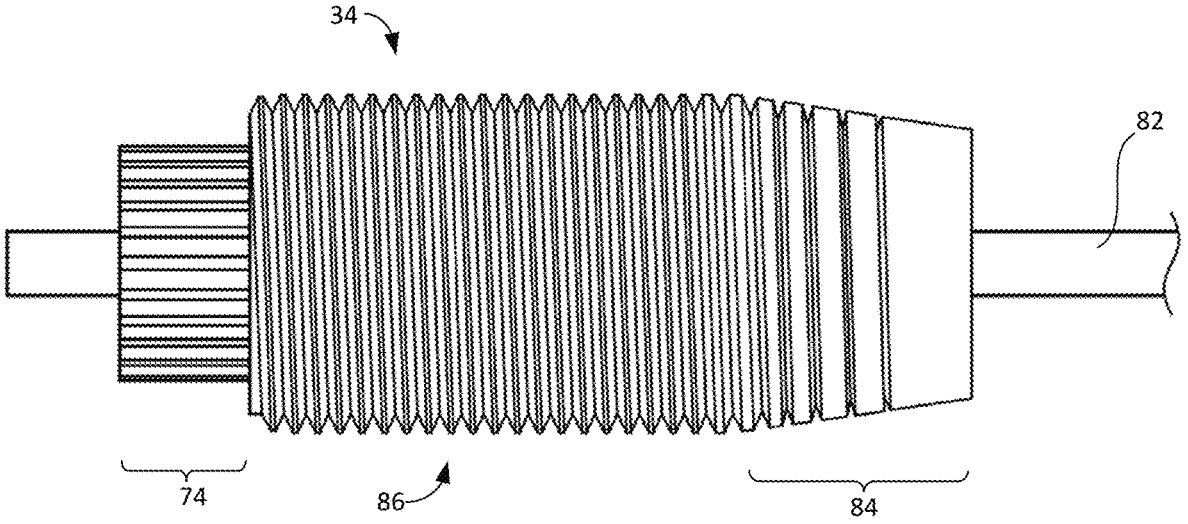
FIG. 6 is a side view of aspects of the invention.
Figure 6A:
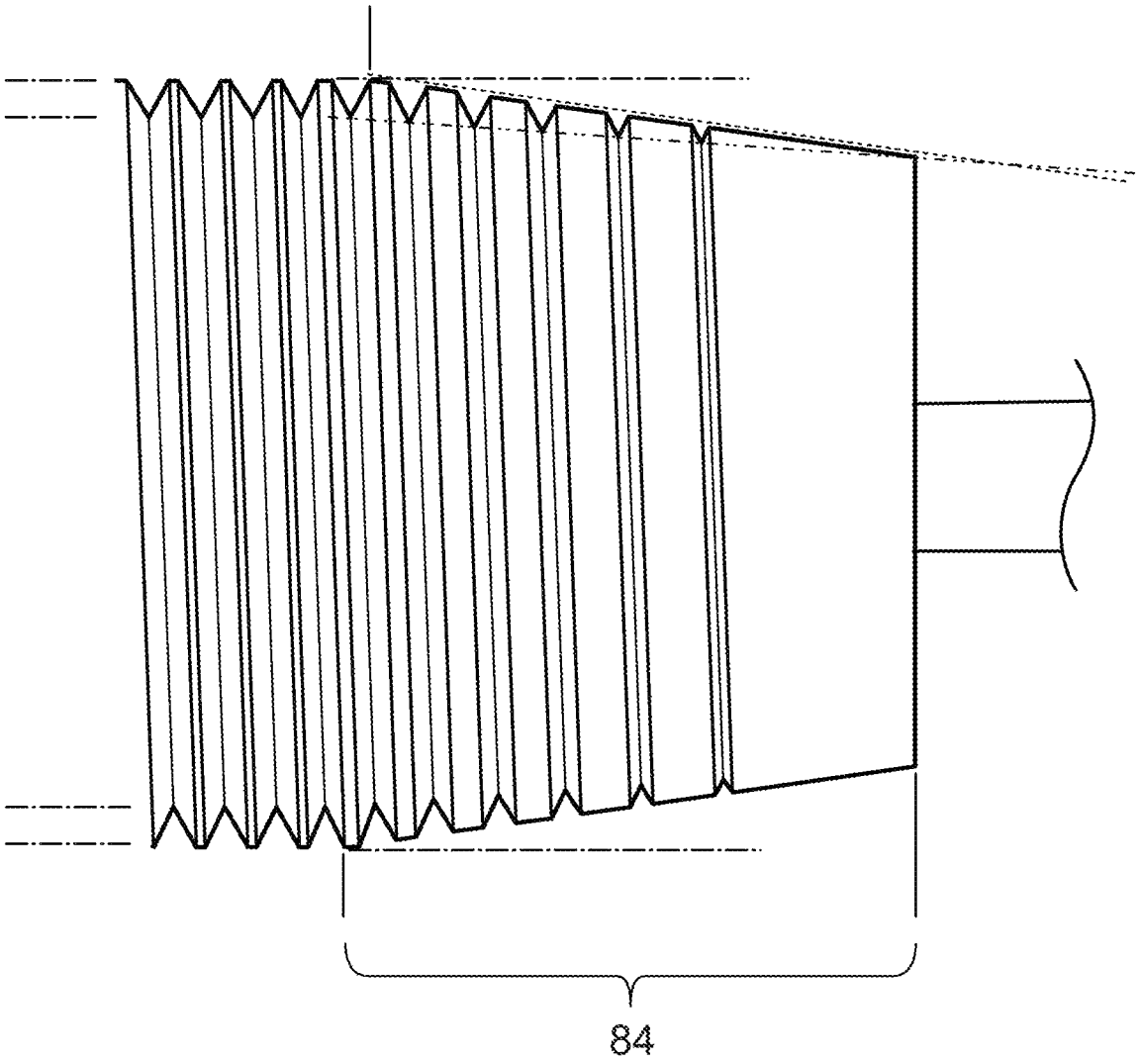
FIG. 6A is a detailed side view of a portion of a pinion showing variations in the pitch and depth of the threads through the transition area according to the present invention.

Referring to FIG. 6, a pinion 34 can include an axle 82 allowing the pinion to rotate relative to the intermediate plate. With additional reference to FIG. 6A, a transition area 84 can be included that has increasing deeper threads to guiding the outer edge of a lid into the pinion threads 86. As shown in FIGS. 6 and 6A, the pitch between the threads continues to narrow through the transition area until becoming uniform following the transition area. A pinion gear 74 can be included to be operatively associated with a drive belt or outer gear and a drive gear actuate rotation of the pinions.

Figure 7:
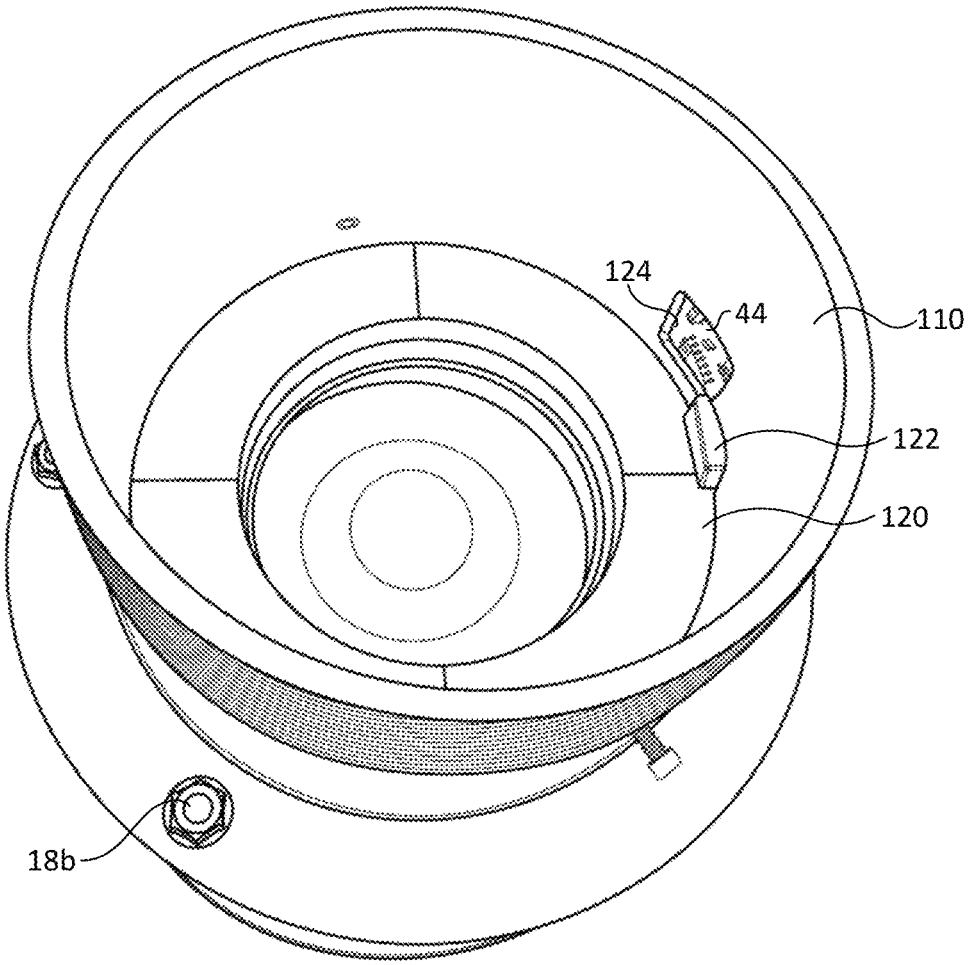
FIG. 7 is a perspective view of aspects of the invention.
Figure 9:
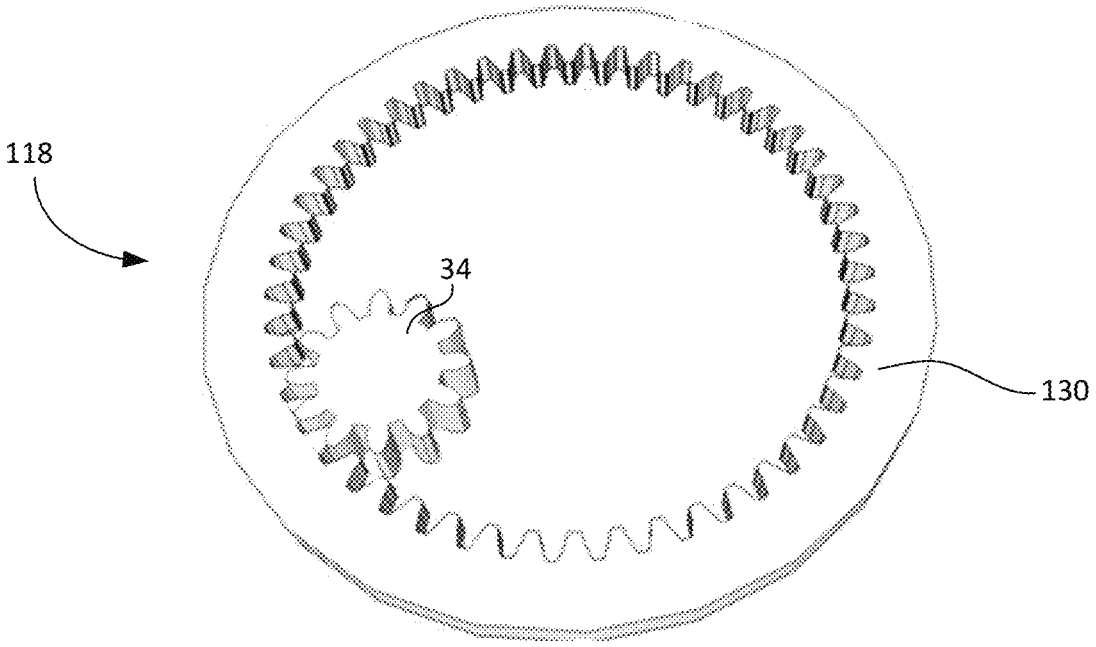
FIG. 9 is a top view of aspects of the invention.

Referring to FIG. 7, the cowl 110 is shown with a cartridge ring 120 received with in the cowl. The cartridge ring can include a cartridge ring stop 122 that can engage with cartridge stop included in the cartridge to prevent the cartridge from over rotating with in the hopper assembly. A cowl opening 124 can be included to allow the level sensor 44 to detect the level of lids in the cowl and therefore the hopper assembly or cartridge. Referring to FIG. 8, a base assembly 126 is shown with base 80 having base openings 128. The base openings can receive the supports and assist in the various assemblies to the base. The base assembly can include one or more bases for securing one or more cup lid dispensers to the base assembly such as may be desired for small, medium and large cup lids. Referring to FIG. 9, components of the drive assembly 118 are shown. The drive gear can be disposed beneath the pinions and inside the outer gear 130 and can engage the teeth of the outer gear. When the drive gear rotates, the outer gear rotates. The pinions can include pinions gears that engage the outer gear so that when the outer gear rotates, the pinions rotate. Therefore, the outer gear can be cooperatively associated with the drive gear and pinion gear to transfer rotational force from the drive motor to the pinions to rotate the pinions.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements, or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

It will be understood by those skilled in the art that one or more aspects of this invention can meet certain objectives, while one or more other aspects can meet certain other objectives. Each objective may not apply equally, in all its respects, to every aspect of this invention. As such, the objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not construed as limiting of the invention. Various modifications and applications may occur to those who are skilled in the art, without departing from the spirit and the scope of the invention, as described by the appended claims. Likewise, other objects, features, benefits, and advantages of the present invention will be apparent from this summary and certain embodiments described below, and will be readily apparent to those skilled in the art. Such objects, features, benefits and advantages will be apparent from the above in conjunction with the accompanying examples, data, figures and all reasonable inferences to be drawn therefrom, alone or with consideration of the references incorporated herein.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. An automatic lid dispenser comprising:

a hopper assembly for receiving and storing an inventory of lids;

a dispensing assembly disposed adjacent to the hopper assembly for receiving lids from the hopper assembly;

a plurality of pinions included in the dispensing assembly wherein the pinions include pinion threads spaced apart to contact a lid edge and wherein the plurality of pinions define an inner diameter that is smaller than a diameter of an unflexed lid so that a lid disposed between said plurality of pinions is bowed relative to said unflexed lid in said inventory of lids to facilitate separation of adjacent lids;

said plurality of pinions each including a transition area having a tapered portion with said pinion threads;

said tapered portion receiving and funneling said lids between said plurality of pinions so that the edges of said lids are guided into said pinion threads following said transition area; and wherein a depth and pitch of said pinion threads in said transition area are variable such that the threads become deeper and spacing between the threads narrows through the transition area, and wherein the depth and pitch of said pinion threads is uniform following said transition area;

a drive assembly included in the dispensing assembly having a drive motor cooperatively associated with the pinions to rotate said plurality of pinions to dispense a lid; and, a ramp disposed under the dispensing assembly for receiving the lid and redirecting the lid external the housing containing the dispensing assembly.

2. The automatic lid dispenser of claim 1 including a buffer having a radius cooperatively associated with the ramp to guide lids dispensed from the dispensing assembly onto the ramp.

3. The automatic lid dispenser of claim 1 including a pair of guide arms attached to the ramp for positioning the lid at a distal end of the ramp.

4. The automatic lid dispenser of claim 1 including:

a ramp sensor carried by the ramp for detecting the presence of a lid on the ramp; and, a control circuit operatively associated with the dispensing assembly activate the dispending assembly when the ramp sensor does not detect a lid on the ramp thereby removing a lid from the lid inventory and dispending the lid onto the ramp.

5. The automatic lid dispenser of claim 4 including a ramp shield attached to the ramp covering the ramp sensor.

6. The automatic lid dispenser of claim 4 including:

a level sensor carried by the hopper assembly; and, a control circuit is connected to the level sensor and configured to prevent activation of the dispensing assembly when the level of lids in the hopper assembly falls below a predetermined level.

7. The automatic lid dispenser of claim 6 including an indicator connected to the control circuit configured to be activated when the level of lids in the hopper assembly drops below a predetermined number.

8. The automatic lid dispenser of claim 6 including an indicator connected to a control circuit configured to be activated by the control circuit when there is no lid present on the ramp for a predetermined period of time.

9. An automatic lid dispenser comprising:

a dispensing assembly receiving lids from a lid inventory;

a plurality of pinions included in the dispensing assembly wherein at least one pinion of the plurality of pinions includes pinion threads configured to contact a lid edge of a lid in the lid inventory; and, wherein the plurality of pinions define an inner diameter that is smaller than a diameter of an unflexed lid so that a lid disposed between said plurality of pinions is bowed relative to said unflexed lid in said inventory of lids to facilitate separation of adjacent lids;

said plurality of pinions each including a transition area having a tapered portion with said pinion threads;

said tapered portion receiving and funneling said lids between said plurality of pinions so that the edges of said lids are guided into said pinion threads following said transition area; and wherein a depth and pitch of said pinion threads in said transition area are variable such that the threads become deeper and spacing between the threads narrows through the transition area, and wherein the depth and pitch of said pinion threads is uniform following said transition area;

a drive assembly included in the dispensing assembly to rotate said plurality of pinions to dispense a lid from the lid inventory.

10. The automatic lid dispenser of claim 9 including a ramp disposed under the dispensing assembly for receiving the lid and redirecting the lid external a housing containing the dispensing assembly.

11. The automatic lid dispenser of claim 9 including a hopper assembly for receiving and storing the inventory of lids.

12. The automatic lid dispenser of claim 9 including a cartridge for storing the inventory of lids.

13. The automatic lid dispenser of claim 9 including:

a ramp disposed under the dispensing assembly for receiving the lid and redirecting the lid external a housing containing the dispensing assembly;

a ramp sensor carried by the ramp for detecting the presence of a lid on the ramp; and, a control circuit operatively associated with the dispensing assembly to activate the dispending assembly when the ramp sensor does not detect a lid thereby removing a lid from the lid inventory and dispending the lid onto the ramp.

* * * * *